United States Patent [19]

Fillers

[11] Patent Number: 4,685,672

[45] Date of Patent: Aug. 11, 1987

[54] GUESSING GAME AND ASSOCIATED PLAYING METHOD

[76] Inventor: Wayne L. Fillers, Rte. 7, Box 501, Greeneville, Tenn. 37743

[21] Appl. No.: 779,664

[22] Filed: Sep. 24, 1985

[51] Int. Cl.[4] ..... A63F 9/00

[52] U.S. Cl. ..... 273/1 R

[58] Field of Search ..... 273/1 G, 1 R, 1 GG, 273/1 GF, 309, 146, 148 R, 274, 1 GC, 401

[56] References Cited

U.S. PATENT DOCUMENTS

| | | | |
|---|---|---|---|
| 1,161,846 | 11/1915 | Clausen | 273/148 R XR |
| 1,445,891 | 2/1923 | Johnson | 273/274 X |
| 3,070,371 | 12/1962 | Hearle | 273/1 R X |
| 3,126,205 | 3/1964 | Jordan | 273/274 X |
| 4,247,114 | 1/1981 | Carroll | 273/146 X |
| 4,303,240 | 12/1981 | Ellman et al. | 273/1 GF |
| 4,309,030 | 1/1982 | Goldfarb et al. | 273/1 GC |
| 4,448,421 | 5/1984 | Zaruba et al. | 273/146 X |
| 4,469,329 | 9/1984 | Guyer | 273/146 |

FOREIGN PATENT DOCUMENTS

| | | | |
|---|---|---|---|
| 2055299 | 3/1981 | United Kingdom | 273/309 |

OTHER PUBLICATIONS

Wood et al, The Boy's Own Treasury of Sports and Pastimes, 8-1881, p. 47, Eggs in the Bush.

Readers Digest, Book of 1000 Family Games, 6-1973, p. 69, Odd or Even.

Grunfeld, Games of the World, 3-1976, pp. 16 & 17, Games to Start a Game.

*Primary Examiner*—Paul E. Shapiro

*Attorney, Agent, or Firm*—Pitts and Brittian

[57] ABSTRACT

A guessing game and associated playing method is provided. The guessing game (10) includes a plurality of game pieces such as marbles. A support structure (12) is provided which includes at least two indented receptacles (14) for selectively receiving the game pieces. These receptacles (14) define the playing positions of the players. Cover members (16) are operatively associated with each of the receptacles (14) and are secured proximate each of the receptacles such that a player can access the game pieces within his receptacle in a concealed fashion.

10 Claims, 2 Drawing Figures

GUESSING GAME AND ASSOCIATED PLAYING METHOD

DESCRIPTION

1. Technical Field

This invention relates to a guessing game and associated playing method, and more particularly concerns a guessing game in which a player gains, or looses, game pieces as a result of his ability to correctly guess the number of game pieces held in a concealed manner in an opposing player's hand.

2. Background Art

Heretofore, games have been known which involve guessing the hand in which an object is concealed. For example, almost every child has, at some point, been involved in guessing the hand in which a coin or other small object is hidden. If the object is small enough, the guess is generally a matter of pure luck. Countrawise, the guessing game and playing method of the present invention is designed to require skill and strategy in order to acquire the greatest number of playing pieces from the other players. In accordance with the method of the invention, a player looses, or gains, such playing pieces based upon his ability to correctly guess the number of playing pieces concealed in an opposing player's hand. It is advantageous to monitor the number of game pieces in possession of the opposing players in order to ascertain game pieces available for concealment. This is done by keeping track or counting the pieces won or lost by opposing players during the course of the game since pieces are contained in a concealed receptacle. U.S. Pat. No. 3,825,255, discloses a prior art device which involves guessing randomly selected numbers. However, such patent discloses a complex apparatus used in the random selection process, and the playing process is substantially based on luck rather than skill and strategy which need to be practiced in the game of the present invention.

Accordingly, it is an object of the present invention to provide a guessing game and associated method which requires a player to rely upon skill and strategy in the selection and concealment of a certain number of game pieces and in the guessing of the number so concealed.

Another object of the present invention is to provide a guessing game apparatus and associated playing pieces which has easy-to-follow rules for playing such that it can be played by skilled and unskilled players of all ages, and which is particularly suitable for the combined playing of children and adults.

A further object of the present invention is to provide a guessing game which calls for the development of skill and strategy in the selection and concealment of playing pieces, as well as skill in the guessing of the number of playing pieces so concealed.

A further object of the present invention is to provide a guessing game and associated board which is inexpensive to manufacture.

DISCLOSURE OF THE INVENTION

Other objects and advantages will be accomplished by the present invention, which provides a guessing game and operatively associated playing method. The guessing game comprises a plurality of game pieces and a support structure which is provided with at least two indented receptacles for selectively receiving the game pieces. These receptacles define the playing position for the opposing players. Cover members conceal the contents of the receptacle and provide concealed access by a player to the game pieces contained within his respective receptacle. The playing method comprises a first round of play wherein each of the players in succession selects and withdraws up to ten or another suitable number of game pieces, from among those game pieces contained in the receptacle comprising his playing position. These game pieces are concealed in the player's hand, thereby allowing each of the other players to guess the number of pieces so concealed. To each player who guesses correctly, the player must pay the number of pieces correctly guessed, and from each player guessing incorrectly, the player receives the number of pieces equal to the difference between the number incorrectly guessed and the number of pieces concealed in the player's hand. The playing method further comprises second and succeeding rounds of play, like the first, except there is no limitation upon the number of pieces a player may conceal in his hand. A player's participation is terminated when he looses all of his playing pieces, and the object of the game is to acquire all of the playing pieces, or to at least acquire a preselected number of playing pieces which is greater than the number of playing pieces held by each of the other players.

BRIEF DESCRIPTION OF THE DRAWINGS

The above-mentioned features of the invention will become more clearly understood from the following description of the invention read together with the accompanying drawings in which.

Figure 1:
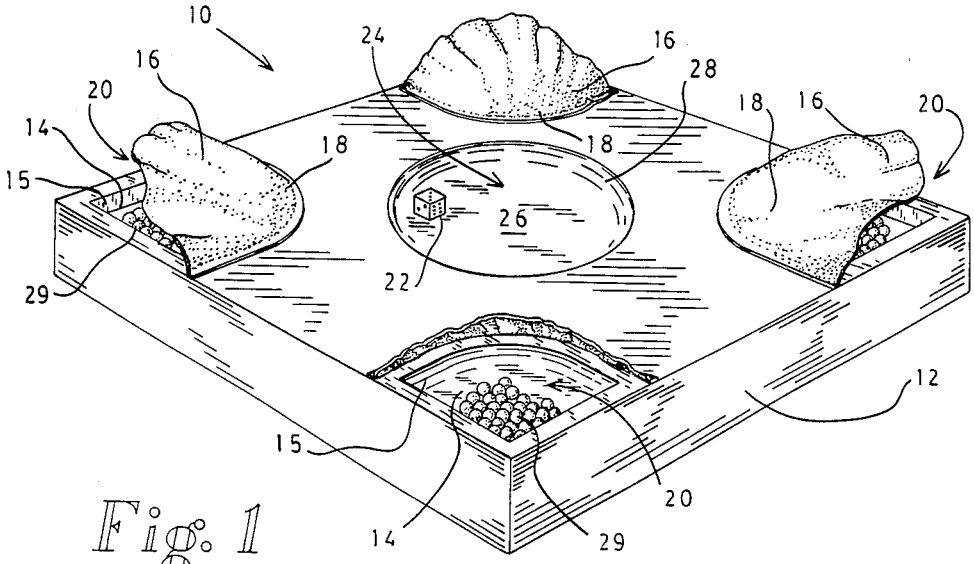
FIG. 1 illustrates a perspective view of the guessing game structure and illustrates various features of the present invention.

A guessing game incorporating various features of the present invention is illustrated generally at 10 in the figures. In the preferred illustrated embodiment, the game 10 comprises a support structure 12 having an upper playing surface defining the indented receptacles 14, each such receptacle 14 comprising a playing position. As illustrated in the figures, in the preferred embodiment of the structure 12 four receptacles 14 are provided. However, as will become apparent from the discussion which follows, the game 10 can be played by two or more players, and it is contemplated that alternate embodiments of the structure 12 can be provided with two or more receptacles 14 depending upon the number of players sought to be accommodated. Further, in the preferred embodiment the structure 12 defines a substantially square configuration with the receptacles 14 defining quarter-circular recesses located at the corners of the structure 12. Whereas this illustrated configuration of the structure 12 results in the advantageous positioning of players about the structure 12, it is contemplated that the geometric configuration of the structure 12, and the location and geometric configuration of the receptacles 14 can vary.

The support structure 12 further comprises means for concealing the contents of a receptacle 14 from the view of an opposing player. In the preferred embodiment such means comprise a cover member 16 operatively associated with each of the receptacles 14. As illustrated, the cover members 16 are secured along a forward edge 18 to the upper surface of the structure 12 and define an outwardly disposed opening 20 for allowing the associated player concealed access to the receptacle 14. In the preferred embodiment of the game 10 the cover members are fabricated of a flexible material capable of collapsing over the receptacle 14, or around the hand of a player as such player accesses a receptacle 14, so as to better conceal the contents of the receptacle 14 and that portion of the game playing process performed within the receptacles 14. However, more rigid fabricating materials can be used if desired so long as the cover members 14 are configured to afford the requisite concealment of the receptacles 14.

A player selection means is also provided for selecting the player who will initiate play. In one embodiment such means comprises a die 22 which is rolled by each player in succession with the player rolling the highest number, or the lowest if desired, being the player who initiates play. In order to accommodate the rolling of the die 22, the preferred embodiment of the support structure 12 is provided with a recessed portion 24 defining a rolling surface 26 and encircling walls 28. It will be appreciated that when the die 22 is rolled on the surface 26 the walls 28 serve to maintain the die 22 within the recessed portion 24 such that the die remains conveniently accessible to the players. In one preferred embodiment, the walls 28 are slopped, as for example by 45 degrees, to facilitate removing the die.

The game 10 further comprises a plurality of game pieces 29, with each player being provided with a preselected number of such game pieces 29. In the preferred embodiment of the game 10 the game pieces 29 comprise spherical members such as marbles, which are small enough in diameter that a plurality of the game pieces 29 can be grasped in a player's hand. Of course, whereas the spherical configuation of the game pieces 29 has been found to be a desirable configuration facilitating the grasping and other manipulation of the game pieces 29, it will be appreciated that various other game piece configurations could be used.

Figure 2:
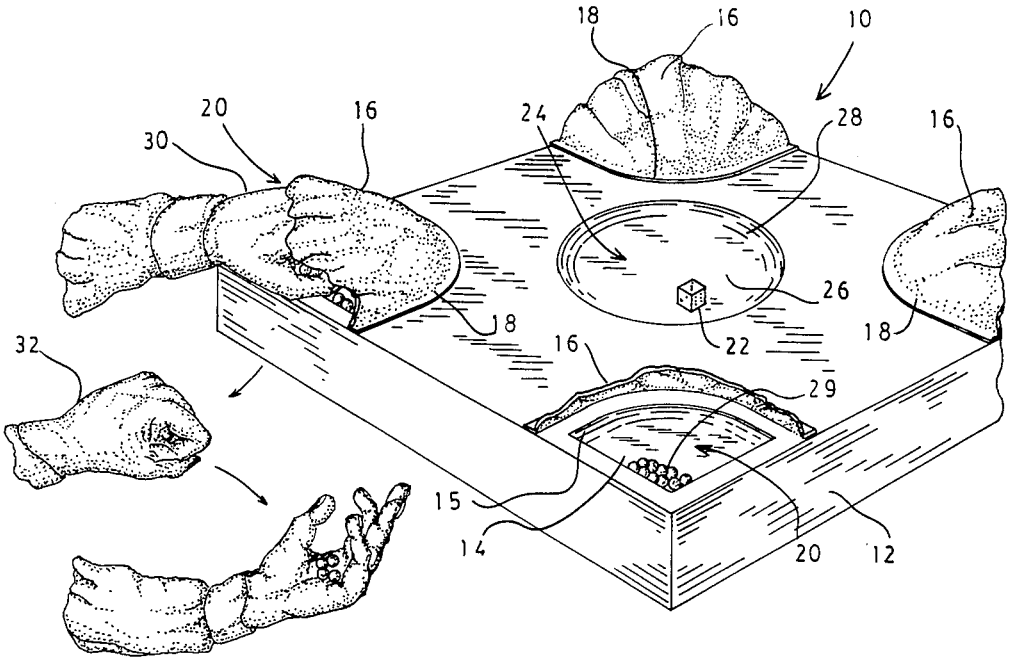
FIG. 2 illustrates a perspective view of the game illustrated in FIG. 1 and its utilization in the successive play selection and concealment of game pieces in the hand of a player.

As to the method for playing the game 10, each player is provided with a preselected number of game pieces 29 which are placed within the player's receptacle 14. It will be noted that in the preferred embodiment of FIG. 1, the side walls 15 of the receptacles 14 are sloped, desirably at approximately a 45 degrees angle, in order to facilitate removal of the game pieces 29 from the receptacles 14. In the preferred method of the present invention, the begining allotment of game pieces for each player is thirty (30). The player who initiates play is then selected, in the preferred embodiment such selection being accomplished using the die 22 as described above. The initial player having been selected, play is initiated by such player accessing his or her receptacle 14 as illustrated at 30 of FIG. 2 and concealing a selected number of game pieces 29 in his or her hand. The initial player's hand is then displayed to the other players in the manner illustrated at 32 in FIG. 2, and in a preselected order (for example, clockwise around the structure 12) the other players guess how many game pieces 29 are concealed in the initial player's hand. If a guessing player guesses the number of game pieces 29 concealed in the initial or concealing player's hand such guessing player receives from the initial player a number of game pieces 29 equal to the number of game pieces concealed and correctly guessed, thereby decreasing the number of game pieces 29 possessed by the initial player and increasing the number of game pieces 29 possessed by the correctly guessing player. If a guessing player fails to correctly guess the number of game pieces 29 concealed, such guessing player must pay to the concealing player a number of game pieces 29 equal to the difference between the number guessed and the number actually concealed, thereby increasing the number of game pieces 29 possessed by the initial player and decreasing the number of game pieces 29 possessed by the incorrectly guessing player. To aid in the exchange of game pieces 29, in the preferred method of the present invention, the game pieces lost by a player are deposited in the recessed portion 24 where they can be counted and removed by the winning player. Further, to aid in the removal of game pieces from the recess portion 24, the encircling walls 28 are sloped at an angle of approximately 45 degrees.

After the initial player has completed his turn as the game piece concealing player, each player, in a preselected order or rotation, takes a turn as the game piece concealing player with the other players attempting to guess the number of game pieces 29 concealed. The object of the game 10 is to capture the game pieces of the opposing players, with the winner being the player who captures all of the game pieces in play or the player who is in possession of the greatest number of game pieces when play is terminated. Of course, when a player loses all of his or her game pieces such player's participation in the game is terminated.

In the preferred method of playing the game of the present invention, the maximum number of game pieces which can be concealed by a player in his first turn as concealing player is ten (10). Limiting the number of game pieces 29 which can be concealed in the first round of play lessens the advantage enjoyed by the player initiating play. It will be appreciated that without such a limitation the initial player would be given an opportunity to substantially reduce the other players' supply of game pieces 29 before they receive a turn as concealing player. Of course, the fewer game pieces a player has the easier it is to guess the number such player is concealing. With the first round limitation on the game pieces concealed, each player has an equal opportunity to emerge from the first round with a numerical advantage in game pieces. Of course, after the first round of play the number of game pieces 29 which can be concealed is limited only by the number of game pieces 29 possessed by a player and/or the number of game pieces which can be held in the player's hand.

It will be appreciated by those skilled in the art that whereas luck plays a part in correctly guessing the game pieces concealed, the game 10 requires skill and strategy as well. For example, it is advantageous to monitor the number of game pieces in the possession of opposing players in order to ascertain the game pieces available to an opposing player for concealment, but because the cover members 16 conceal the game pieces of the opposing players the number of game pieces in the possession of an opposing player must be monitored by keeping track of the game pieces won and lost by opposing players. Further, thought must be given to the number of game pieces selected for concealment. A player can reduce the risk of loss of game pieces on his or her turn as concealing player by selecting a small number of game pieces. However, selection of a small number of game pieces tends to be reflected in the posture of the player's hand as it is displayed to the opposing players, and the guesses of the opposing players tend to be closer where a small number of pieces are concealed thereby reducing the number of game pieces won by the concealing player. On the other hand, there tends to be a greater disparity between the number concealed and the numbers guessed where a large number of game pieces are concealed, but a single correct guess where a large number of game pieces is concealed can be devastating to the concealing player. Accordingly, the game 10 can be played aggressively or conservatively depending upon the strategy deemed by the player to be most effective under the prevailing circumstances.

Thus, it will be appreciated that considerable practice and skill are required to become a proficient player of the game of the present invention, yet the rules are not so complex as to preclude enjoyment of the game by the novice or unskilled player such as children. The game is also designed to promote and to a great extent, require, the employment of creative strategies in the selection and concealment of game pieces 29 and in the guessing of the number of the number of game pieces concealed. Further, while the game 10 requires a minimum of two players and while the preferred embodiment of the figures illustrate four playing positions, there is no set limit on the number of players.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A guessing game for being played by a plurality of players, said game comprising:

a plurality of game pieces;

a support structure provided with at least two indented receptacles for selectively receiving said game pieces, each said receptacle defining a playing position; and a cover member operatively associated with each of said receptacles for concealing the contents of each said receptacle, each said cover member secured at its forward edge to said support structure and defining an outwardly disposed opening for allowing an associated player concealed access to said receptacle, said cover member fabricated of a flexible material capable of collapsing over its operatively associated receptacle.

2. The game of claim 1 wherein said game pieces comprise small spherical members such as marbles.

3. The game of claim 1 wherein said support structure is substantially square in configuration and defines four corners.

4. The game of claim 3 wherein said receptacles define quarter-circle recesses which are located at the corners of the structure.

5. The game of claim 1 including player selection means provided for selecting a player who will initiate play.

6. The game of claim 5 wherein said player selection means comprises a die and wherein said support structure is provided with a recess portion which defines a rolling surface and an encircling wall such that the die can be rolled on such rolling surface with the walls serving to maintain the die within said recessed portion whereby the die remains conveniently accesible to the players.

7. A guessing game for being played by a plurality of players, said game comprising:

a plurality of game pieces wherein said game pieces comprise small spherical members such as marbles;

a support structure provided with at least two indented receptacles for selectively receiving said game pieces, each said receptacle defining a playing position, said support structure being substantially square in configuration, defining four corners; and a cover member operatively associated with each of said receptacles for concealing the contents of each said receptacle from the view of an opposing player, each said cover member secured at its forward edge to said support structure and defining an outwardly disposed opening for allowing an associated player concealed access to said receptacle, said cover member fabricated of a flexible material capable of collapsing over its operatively associated receptacle.

8. The game of claim 7 wherein said receptacles define quarter-circle recesses are located at the corners of the structure.

9. The game of claim 7 including player selection means provided for selecting a player who will initiate play.

10. The game of claim 9 wherein said player selection means comprises a die and wherein said support structure is provided with a recess portion which defines a rolling surface and an encircling wall such that the die can be rolled on such rolling surface with the walls serving to maintain the die within said recessed portion whereby the die remains conveniently accessible to the players.

* * * * *